United States Patent [19]

Zumbrunn et al.

[11] Patent Number: 4,536,907

[45] Date of Patent: Aug. 27, 1985

[54] PROCESS FOR EFFECTING AN ACCELERATED NEUTRALIZATION OF CELLULOSE TEXTILE SUBSTRATES IMPREGNATED WITH ALKALINE HYDROXIDE

[75] Inventors: Jean-Pierre Zumbrunn, Eaubonne; Jean Levielle, Chaource; André Thomas, Troyes; Francoise Grangette, Bourg-la-Reine, all of France

[73] Assignee: L'Air Liquide, Societe Anonyme Pour L'Etude Et L'Exploitation Des Procedes Georges Claude, Paris, France

[21] Appl. No.: 554,797

[22] Filed: Nov. 23, 1983

[30] Foreign Application Priority Data

Nov. 29, 1982 [FR] France ..... 82 19963

[51] Int. Cl.[3] ..... D06B 3/10

[52] U.S. Cl. ..... 8/149.1; 8/149.2; 8/151; 8/152; 8/158; 68/5 C; 68/178

[58] Field of Search ..... 8/149.1, 149.2, 151, 8/152, 158, 137, 125; 68/9, 5 C, 5 D, 5 E, 177, 178, 183

[56] References Cited

U.S. PATENT DOCUMENTS

| | | | |
|---|---|---|---|
| 1,209,465 | 12/1916 | Matter | 8/125 X |
| 2,632,732 | 3/1953 | Steele | 8/125 X |
| 3,041,863 | 7/1962 | Goto | 68/5 E |
| 3,160,896 | 12/1964 | Smith, Jr. | 8/158 X |
| 3,406,413 | 10/1968 | Ridley | 8/158 |
| 3,457,025 | 7/1969 | Barber et al. | 8/125 X |
| 3,921,420 | 11/1975 | Aurich et al. . | |
| 4,099,911 | 7/1978 | Lawrence | 68/5 D X |
| 4,104,753 | 8/1978 | Schuirer . | |
| 4,164,050 | 8/1979 | Stakelbeck | 8/149.1 |
| 4,219,333 | 8/1980 | Harris | 8/149.1 X |

*Primary Examiner*—Philip R. Coe
*Assistant Examiner*—Frankie L. Stinson
*Attorney, Agent, or Firm*—Browdy and Neimark

[57] ABSTRACT

There is effected an accelerated direct neutralization in-situ of the substrates which are impregnated with alkaline hydroxide which is free or fixed on the cellulose, by contact with a neutralizing fluid containing carbon dioxide in a gaseous, aqueous or combined phase, this fluid being introduced in accordance with requirements related to the quantity of alkali to be neutralized. The process may be used in the textile industry in continuous and discontinuous treatments and is adaptable to all types of textile machines employing an aqueous method.

25 Claims, 3 Drawing Figures

Figure 1:
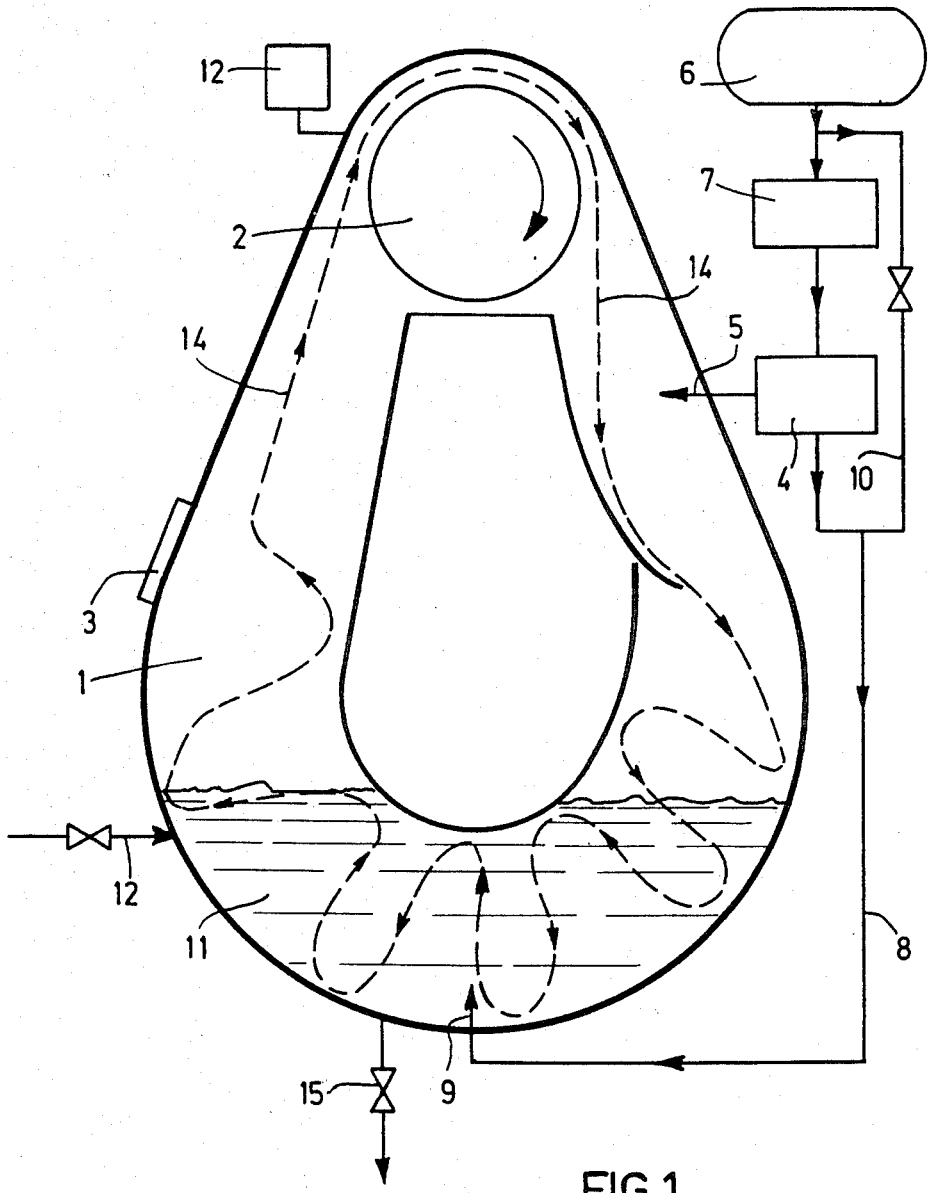

PROCESS FOR EFFECTING AN ACCELERATED NEUTRALIZATION OF CELLULOSE TEXTILE SUBSTRATES IMPREGNATED WITH ALKALINE HYDROXIDE

The present invention relates to a process for effecting an accelerated neutralization of cellulose textile substrates and equipment for carrying out said process.

The textile industry and more especially that producing particular qualities of pure or mixed cotton in the thread, woven or knitted form, employ techniques of mercerizing or causticizing. These operations are carried out by putting the cellulose material in contact with an aqueous solution of caustic soda. The material which has acquired the required particular qualities issues from the mercerizing or causticizing machine impregnated with washing soda. Squeezing by means of pressing rolls permits a limiting of the amount of washing soda carried along by the material. Rinsings are then carried out in order to remove the residual alkali. But the cellulose has a high chemical affinity for the soda and the divided character of the fibres encourages a retention of liquid by capillarity. It is therefore necessary to multiply the rinses with larger volumes of water and to interpose rinsing with acidulated water for eliminating the caustic soda and to break the soda-cellulose chemical bond, termed alkali-cellulose, $C_{12}H_{20}O_{10}$, 2 NaOH.

One of the conventional processes , which is discontinuous, for eliminating the alkali comprises effecting a succession of rinsings requiring the use of repeated charges of cold, hot, acidulated water in the same machine for a given charge of textile.

Another usual process, which is continuous, comprises using a succession of rinsing machines arranged in series, which may be roller vats; the textile travels through the machines in a continuous manner.

By way of example, a jersey cotton issuing from a causticizing machine from which the excess of washing soda has been removed as far as possible by squeezing between two pressing rolls requires, according to the known technique for 100 kg of dry material impregated with a substantially equal weight of causticizing washing soda, at about 25% of caustic soda NaOH, the succession of the following rinsings in a discontinuous manner in the same machine:

1st operation, rinsing with 1000 liters of cold water, duration 15 minutes;

2nd operation, rinsing with 1000 liters of water at 60° C., duration 15 minutes or more;

3rd operation, rinsing with 1000 liters of cold water charged with a few kg of acetic acid, duration 15 minutes;

4th operation, rinsing with 1000 liters of cold water, duration 15 minutes;

5th operation, identical to the preceding operation.

The toal duration of the operations with the idle times included, is about two hours or more if the hot rinsing water is not preheated. The modified mode employing the continuous technique uses the same baths in a succession of machines or enclosures.

The abundance of the volumes of cold, hot or acidulated water is essential to avoid any trace of residual alkali which has a harmful effect on the quality and may even have a disturbing effect on other subsequent operations, for example dyeing.

The drawbacks of the technique just described are clearly evident and industrial practice confirms them. The discontinuous technique requires a great amount of water and labour for the handling, for the controls and the idling times of the machine; and the continuous technique requires a great amount of water and machine and floor space investments.

Further, there is alway a risk of retention of alkali. Consequently checkings of the pH are required to ensure that it is not necessary to carry out an additional rinsing operation.

Another drawback common to the two processes relates to the environment. Indeed, the rinsing of 100 kg of textile according to the above example, produces 5000 liters of polluted water per about 25 kg of pure caustic soda, which is very incompletely neutralized by the intermediate charge of acidulated water. Indeed, for example, 3 kg of acetic acid would only neutralize 2 kg of caustic soda and 23 kg, namely 92% thereof, would remain in the free state. It is therefore essential, in order to abide by the waste water discharging standards, to provide a purifying station capable of neutralizing this alkalinity, which involves additional technical and economic constraints for the textile enterprise.

Work has now been carried out for developing a process for completely eliminating the risks of residual alkalinity in the textile fibres while producing an effluent whose pH corresponds to a complete absence of caustic soda. Further, it has been attempted to avoid large consumptions of water and the pollution while saving energy and reducing the treatment times.

According to the proposed process, the accelerated direct neutralization of the cellulose textile substrates impregnated with alkaline hydroxide which is free or fixed on the cellulose is carried out in-situ by contact with carbon dioxide without prior rinsings.

The carbon dioxide behaves in respect of the alkaline cellulose textile substrates as an active gas reacting, on one hand, on the caustic soda NaOH, and, on the other hand, on the alkali-cellulose chemical bond. The direct reaction of the carbon dioxide with the free caustic soda and the alkali-cellulose has for advantageous consequence an immediate in-situ neutralization, with formation in both cases of hydrogen-sodium carbonate, termed sodium bicarbonate, which is a practically neutral and harmless product for the environment.

Hydroscopicity of the caustic soda, its property of resulting in viscous solutions and its high chemical affinity for the cellulose were responsible for the great difficulties of its elimination. As the hydrogen-carbonate is a mineral salt whose physical and chemical properties are different, it can be much more easily eliminated. Consequently, the alkalinity of impregnation of the textile is immediately converted into hydrogen-sodium carbonate which is eliminated by a summary rinsing with water and the rinsing operations in multiple baths are eliminated.

Another advantage of the present invention resides in the fact that the sodium bicarbonate, which is a neutral salt, does not affect a possible subsequent treating operation on the causticized or mercerized textile, for example the bleaching or dyeing. Consequently, it is not always indispensable to rinse abundantly the neutralized textile charge before said operation, which represents a saving in time and water.

The effluents issuing from the neutralization and its possible rinsings are, by definition, neutral or have a pH in the neighbourhood of 8 and at the most 8.3, which is a value compatible with the waste water discharge standards. Thus, they may be discharged directly with no complementary treatment. Further, an accidental discharge of water charged with sodium hydroxide which may therefore have a pH of 10 to 14, which is distinctly higher than the discharge tolerances, is impossible, whence an advantageous major factor as concerns risks of accidental pollution.

The reactions of alkali-cellulose and caustic soda with the carbonic acid $H_2CO_3$ are practically instantaneous. The duration of neutralization therefore only depends upon the temperature, on the rate of injection of the carbon dioxide in the neutralizing enclosure and, of course, on the capacity of the neutralizing machine to ensure a rapid contact between the reagent and the products to be neutralized.

The contact between the substrate impregnated with alkaline hydroxide which is free or fixed on the cellulose, and the neutralizing fluid containing the carbon dioxide may be achieved in a gaseous phase, in an aqueous phase or in combined gaseous and aqueous phases, the order of the phases being a function of the type of continuous or discontinuous process. The neutralizing fluid is introduced as required with respect to the quantity of alkali to be neutralized.

The carbon dioxide may be put into contact with the cellulose substrate impregnated with alkaline hydroxide, in the gaseous state, which corresponds to the creation of a neutralizing atmosphere.

It is also possible, and even advantageous, to effect the direct neutralization of the alkaline hydroxide which is free or fixed on the cellulose, by the spraying onto the cellulose textile substrate of a saturated aqueous solution of carbon dioxide, namely an aqueous solution containing carbonic acid, $H_2CO_3$. The carbon dioxide may be sprayed simultaneously with the steam.

The spraying onto the alkaline cellulose substrate of a solution of carbonic acid supersaturated with gaseous carbon dioxide, therefore a gas-water-carbonic acid emulsion, corresponds to an advantageous possibility of the carrying out of the process of the invention.

The water of said solutions may be brought to a temperature of 30° to 90° C., and preferably 70° to 80° C., which substantially improves the kinetics of the reaction, with respect to the use of cold water. The technique of the spraying of an emulsion has the advantage of allowing the wrung textile, that is a textile squeezed by the pressing rolls of the mercerizing or causticizing machine, to resume volume by swelling under the action of the water—$CO_2$—$CO_3H_2$ emulsion, whence a deep penetration of the neutralizing solution and an activation of the procedure.

All the treatments creating a neutralizing gaseous atmosphere may be considered to be treatments in the gaseous phase.

The accelerated neutralizing process for cellulose textile substrates by means of carbon dioxide is applicable in the treatment of textiles in the aqueous mode in the continuous and discontinuous processes in equipment effecting a contact.

In a continuous process for treating a cloth in the form of a sheet, knitwear or a thread, it is considered that the textile issues from the causticizing or mercerizing operation by passing through a system for squeezing out a maximum amount of the caustic liquor; and it is the cotton impregnated with the remainder of sodic liquor and the alkali-cellulose formed which must be neutralized.

The in-situ neutralizing technique comprises a projection onto the textile material, which travels at a constant rate, of a gaseous stream of carbon dioxide or an aqueous water—$CO_2$—$CO_3H_2$ emulsion as previously described, with distribution at one or more points in accordance with the width of the textile sheet. The supply pressure of the gas or emulsion is so adjusted that the neutralizing jet passes through the material and already achieves a pre-neutralization in depth.

As the neutralization is carried out in a closed enclosure, the latter remains permanently filled with carbon dioxide, which permits obtaining a contact with the textile material, propitious to a possible complementary neutralization by the gaseous carbon dioxide.

The consumption of carbon dioxide by the alkali impregnating the fibres may imply a depression inside the treating enclosure, also a regulation of the gas pressure ensures the supply of gaseous carbon dioxide for the purpose of a complementary neutralization.

The regulation is independent of the degree of impregnation of the textile and of the concentration of alkali, it only reacts upon the demand of neutralizing gas which is itself dependent on the presence of caustic soda and alkali-cellulose in the material being treated.

This mode of regulation results in great safety in use and permits a saving of reagent since, in the event of stoppage of the introduction of the alkaline textile or in the event of the passage of a non-alkaline product, the injection of neutralizing fluid will be automatically stopped as soon as the set pressure is reached.

The very short time of contact between the textile material and the neutralizing reagent, of the order of 15 of 20 seconds, is compatible with the rate of travel of the material.

It has been found advantageous to arrange that the preceding neutralizing phase, termed a gaseous phase, be followed by an aqueous phase. The treatment in the aqueous phase is carried out by impregnation of the textile with water saturated with carbon dioxide. This impregnation with water containing carbonic acid $H_2CO_3$ permits the elimination, if need be, of the last traces of alkalinity of the textile while ensuring a pre-rinsing.

The association of a neutralizing treatment with carbon dioxide in a gaseous phase, with a treatment in the aqueous phase represents a manner of proceeding which is technically very interesting.

In the course of the treatment in the aqueous phase, the introduction of carbon dioxide in the water is so controlled and regulated as to introduce the carbon dioxide as soon as the pH of the aqueous impregnation solution returns toward alkaline values. This introduction is completed by a supply of new water and a draining, the flows of which are calculated in such manner as to avoid the accumulation of hydrogen-sodium carbonate. In the case of the use of the injection of a water—$CO_2$—$CO_3H_2$ emulsion, the new water is supplied by this injection and it is therefore unnecessary to renew the water at the base of the vat for the pre-rinsing. The excess of neutral water is continuously eliminated in the conventional manner.

A final rinsing in water is carried out for the textile which is considered as a finished material. This rinsing may be of a summary kind if the textile undergoes a complementary bleaching or dyeing treatment since it is only impregnated with hydrogen-sodium carbonate.

All the effluents issuing from the continuous treatment are neutral or have at the most a pH of 8.3, so that they are compatible with the standards of the discharge of industrial effluents.

The characteristics of the direct and accelerated neutralization are applicable in the discontinuous processes and may be used in equipment operating by contact.

The neutralizing treatment is carried out per charge; the general principles of the treatment being identical to those described for the continuous system. As before, there is carried out a neutralizing treatment in an aqueous phase with creation of a carbon dioxide atmosphere Then this first treatment is completed by a neutralization in an aqueous phase by impregnation in a saturated aqueous solution of carbon dioxide or a water—$CO_2$—$CO_3H_2$ emulsion.

The treatment is carried out preferably in an enclosure filled with a carbon dioxide atmosphere, preferably provided with a vat bottom containing dissolved carbonic gas in which the textile is immersed. The textile band, whose ends are interconnected so as to form a loop, travels through the enclosure for the neutralization and then the rinsing.

The equipment for carrying out the process of an accelerated neutralization of cellulose substrates may be of any conventional type to which are added a gas pressure detector connected to a gas pressure regulator in the sealed treating enclosure associated with a flow meter for the neutralizing fluid coming from a supply of said fluid and means for distributing and injecting the neutralizing fluid.

However, it has been found to be advantageous to construct certain equipment more specifically adapted to the process.

In respect of equipment for a discontinuous neutralization, the point of injection of the neutralizing fluid is located at the bottom of the treatment enclosure and the point of insertion of the detector is located in the upper half of said enclosure. FIG. 1 of the accompanying drawing shows by way of example a discontinuous textile machine.

This equipment, which is of the discontinuous dyeing machine type, comprises a closed sealed enclosure 1 provided with a winch 2, a door and a lock system 3 for introducing and withdrawing the textile.

This dyeing machine is equipped with equipment specific to the neutralization with carbon dioxide which comprises a gas pressure regulator 4 which controls the supply of neutralizing fluid, the detecting means of the regulator 5 regulates a gas pressure in the enclosure by controlling the distribution of the carbon dioxide coming from a reserve supply 6 by way of the flowmeter 7 and supply piping 8 and the point of injection 9 at the bottom of the treatment enclosure. The supply of gas through 7 and 4 is provided with a bypass 10 through which the enclosure is drained of its air if need be while saturating the vat base 11 with water introduced by way of the value 12 (used for the filling or the rinsing). The valve 13, which is calibrated to operate at a few millibars above the calibration of the pressure regulator 4, permits the discharge of the draining product and acts as an anti-overpressure safety means. The winch 2 is then actuated and causes the sheet of cloth 14 to travel both in the upper part of the enclosure 1 provided with carbon dioxide and in the vat base 11 containing water saturated with carbon dioxide.

The reaction of neutralization of the soda into hydrogen-sodium carbonate is instantaneous and its duration only depends on the capacity of introduction of the carbon dioxide controlled by the pressure regulator 4; the consumption of carbon dioxide only depends on the alkaline requirement created by the cloth.

The end of the reaction is indicated by the flowmeter 7 which indicates the stoppage of the circulation of the carbon dioxide in the supply circuit 8. The water of the vat base charged with sodium bicarbonate may be eliminated with no complementary treatment by the actuation of the drainage valve 15.

EXAMPLE OF APPLICATION

Introduced by way of the door or a lock system is a charge of cotton cloth issuing from a causticizing machine and impregnated with causticizing liquor of which the content, corresponding to the caustic soda and the alkali-cellulose in the combined amount, is 25 kg, expressed in NaOH. The enclosure is if desired drained of its air while the vat base is saturated with water, the valve being calibrated premenantly at a few millibars above the calibration of the gas pressure regulator of the enclosure. The winch is actuated so as to cause the sheet of cloth to travel both in the enclosure provided with gaseous $CO_2$ and in the vat base saturated with $CO_2$. When the end of the reaction is given by the stoppage of the gas stream displayed by the flowmeter, there may be introduced a new charge of water of 1000 liters for the rinsing of the 100 kg of neutralized cloth.

The vat base is heated to 70° to 80° C. for 10 minutes in the particular case of this example. The time required for the neutralization and the rinsing is at the most 20 minutes.

There is observed a consumption of $CO_2$ of 29 kg, namely a utilization rate of 95%. The additional 5% of $CO_2$ corresponds to inevitable losses due to defects in the sealing of the system.

Figure 2:
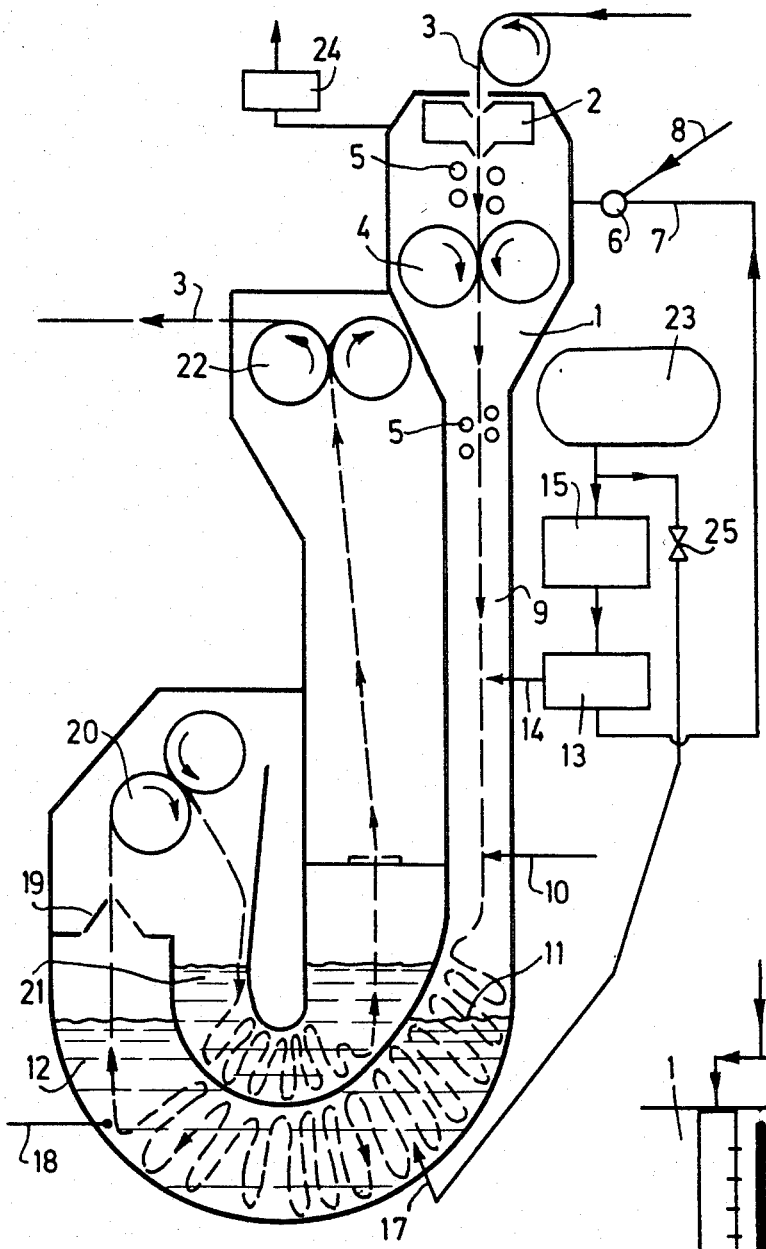

FIG. 2 of the accompanying drawing shows by way of example a continuous textile machine which combines the neutralizing and rinsing plants.

This equipment in which the textile travels vertically comprises a sealed closed enclosure having a vertical section in which is carried out the treatment for neutralizing the textile material in a gaseous phase, extended by a curved section in which is carried out the treatment in an aqueous phase, completed by the rinsing section proper and the vertical section in which the treated cloth rises.

This assembly operates in the following manner, there being taken for example a sheet of cloth issuing from a causticizing machine after the excess of sodic liquor has been squeezed out by pressing rolls.

The upper part of the first vertical section 1 is provided with sealing means 2 such as flexible lips, and the material to be treated 3 is introduced into the enclosure by a system of feed rolls 4 whose speed of rotation permits a regulation of the travelling speed of the cloth. This first part of this vertical section 1 in which the cellulose substrate travels downwardly, is provided with at least one series of projecting means 5 for projecting the neutralizing fluid disposed in a direction perpendicular to the direction of travel of the textile and to the two sides of the latter, upstream or downstream of the feed rolls 4. These spraying means 5 are of conventional type, for example formed by a series of perforated tubes or nozzles which are placed in confronting relation to each side of the textile and in staggered relation to one another so as to project an emulsion of carbon dioxide and water onto the cloth with sufficient upstream pressure to ensure that the jets pass through the cloth without impeding their effect and permit an in-depth neutralization. The pressure of the neutralizing fluid is adjusted in accordance with the thickness of the cloth.

Figure 3:
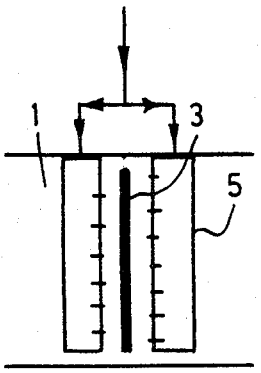

FIG. 3 shows a series 5 of perforated tubes disposed on each side of the cloth and supplied with emulsion by a conventional mixing-emulsifying system 6 to which leads the $CO_2$ supply pipe 7 and the hot water pipe 8 (represented by a ramp). In the particular case, a temperature of about 70° C. for the water is advantageous.

After having been treated for neutralization by the projection-spraying in the region of the nozzles 5, the sheet of cloth reaches the middle and lower part 9 of the first vertical section whose atmosphere is formed by the excess carbon dioxide projected. The length of this second section is so determined as to obtain a contact time of 15 to 30 seconds. A further neutralization can be achieved, if need be, by introduction of gaseous carbon dioxide at 10 under the control of a regulator 13 of the type described with another detector 14 (not shown).

The section of the enclosure 1 is defined in its upper part by the inlet or sealing lock chamber 2 and in its lower part by the water level 11, the water being contained in the curved part 12 of the equipment, this water level being termed the vat base.

The flow of $CO_2$ is regulated automatically by means of a pressure regulator 13 identical to that described and shown in FIG. 1 whose detector 14 is placed in the vertical part charged with gas, for example at the level indicated in FIG. 2.

An overpressure of a few millibars is permanently ensured by this regulation which controls the inlet of the $CO_2$ through the $CO_2$—water—$CO_3H_2$ emulsion injection system. The requirements in $CO_2$ are regulated by the consumption due to the alkalinity of the textile. Any excess of $CO_2$ results in a non-absorption by the textile and is not used in the enclosure 1, bringing about an immediate overpressure detected by the regulation; the latter reacts by stopping the injection. The consumption of carbon dioxide is consequently automatically regulated in accordance with the requirements of the textile.

The pressure detecting means 14 controls the supply of carbon dioxide through the flowmeter 15 and the supply piping 7 and 16, the latter leading to the enclosure at 10 and the carbon dioxide being taken from a stored supply 23.

A neutralization safety, the use of which is optional, depends on the degree of alkalinity of the cloth and is ensured by the complementary injection of carbon dioxide at 17 inside the curved lower section 12 of the treatment equipment in the vat base 11. This complementary injection of carbon dioxide is controlled by a conventional pH regulation of the vat base 11, the sensor 18 being for example placed at the point indicated in FIG. 2. This safety system may enable an exceptional alkalinity point to be absorbed.

After the neutralizing treatment, the cloth issues from the curved section 12 through a sealing lock system 19 which is optional and affords additional safety, although the carbon dioxide must not issue from the equipment in this region. The cloth taken up by the rolls 20 is driven toward the rinsing section 21 and then guided by the rolls 22 whose speed of rotation, coupled to that of the rolls 20 and 4, determines the rate of travel of the cloth.

Liquid levels are adjusted by conventional devices such as overflows (not shown) and the water flows are adjusted in accordance with criteria of elimination of hydrogen-carbonate so as to avoid an accumulation thereof.

All of the effluents issuing from the equipment are at a pH of 8 to 8.3. The results and the performances are identical to those achieved in the discontinuous treatment.

Further, a safety value 24 and a bypass 25 system for the pressure regulator identical to that of FIG. 1 is disposed on the treatment enclosure so as to draw off air.

What is claimed is:

1. A process for neutralizing wet cellulose textile substrate, from which water has been squeezed, impregnated with alkaline hydroxide which is at least in part fixed on the cellulose in the form of alkali-cellulose, comprising effecting in-situ an accelerated and directed neutralization of said impregnated textile substrates by contact of said textile substrates with a neutralizing fluid containing carbon dioxide in a quantity sufficient to substantially neutralize and alkali hydroxide and provide a pH in the textile of at most 8.3, followed by rinsing of said textile substrate with water, or bleaching or dyeing said cellulose textile substrates.

2. A process according to claim 1, wherein said carbon dioxide is in a gaseous phase.

3. A process according to claim 1, wherein said carbon dioxide is in an aqueous phase.

4. A process according to claim 1, wherein said carbon dioxide is in a combined gaseous and aqueous phase.

5. A process for neutralizing cellulose textile substrates impregnated with alkaline hydroxide according to claim 1, comprising putting the cellulose textile substrate in contact with carbon dioxide in a gaseous state.

6. A process for neutralizing cellulose textile substrates impregnated with alkaline hydroxide according to claim 1, comprising effecting a direct neutralization in a gaseous phase by projecting in the form of a spray onto the cellulose substrate an aqueous solution saturated with carbon dioxide, said solution having a temperature of between 30° and 90° C.

7. A process according to claim 6, wherein said temperature is between 70° and 80° C.

8. A continuous process for neutralizing celluose textile substrates impregnated with alkaline hydroxide according to claim 6, comprising directly neutralizing the cellulose textile substrate, which is made to travel constantly, followed by an optional complementary neutralization by gaseous carbon dioxide and then effecting a subsidiary treatment in an aqueous phase.

9. a process according to claim 8, wherein said temperature is between 70° and 80° C.

10. A process for neutralizing cellulose textile substrates impregnated with alkaline hydroxide according to claim 1, comprising effecting a direct neutralization in a gaseous phase by projecting in the form of a spray onto the cellulose textile substrate an aqueous solution containing carbonic acid, the water of said solution having a temperature of between 30° and 90° C.

11. A process according to claim 10, wherein said temperature is between 70° and 80° C.

12. A continuous process for neutralizing cellulose textile substrates impregnated with alkaline hydroxide according to claim 10, comprising directly neutralizing the cellulose textile substrate, which is made to travel constantly, followed by an optional complementary neutralization by gaseous carbon dioxide and then effecting a subsidiary treatment in an aqueous phase.

13. A process according to claim 12, wherein said temperature is between 70° and 80° C.

14. A process for neutralizing cellulose textile substrates impregnated with alkaline hydroxide according to claim 1, comprising effecting a direct neutralization in a gaseous phase by projecting in the form of a spray onto the cellulose textile substrate an aqueous solution of carbonic acid supersaturated with carbon dioxide, the water of said solution having a temperature of between 30° and 90° C.

15. A process according to claim 14, wherein said temperature is between 70° and 80° C.

16. A continuous process for neutralizing cellulose textile substrates impregnated with alkaline hydroxide according to claim 14, comprising directly neutralizing the cellulose textile substrate, which is made to travel constantly, followed by an optional complementary neutralization by gaseous carbon dioxide and then effecting a subsidiary treatment in an aqueous phase.

17. A process according to claim 16, wherein said temperature is between 70° and 80° C.

18. A process for neutralizing in a gaseous phase cellulose textile substrate impregnated with alkline hydroxide according to claim 1, further comprising regulating pressure in the course of the treatment to control the quanity of neutralizing fluid introduced as a function of the quantity of alkali to be neutralized.

19. A process for neutralizing in an aqueous phase cellulose textile substrates impregnated with alkaline hydroxide according to claim 1, comprising neutralizing by impregnation of the cellulose textile substrate in an aqueous liquor containing dissolved carbon dioxide the content of which carbon dioxide is controlled by a regulation of the pH which reacts to the alkalinity by allowing the injection of the carbon dioxide.

20. A discontinuous process for neutralizing cellulose textile substrates according to claim 1, wherein the cellulose textile substrate travels in a carbon dioxide atmosphere and is then impregnated in an aqueous liquor containing dissolved carbon dioxide.

21. A process according to claim 1 wherein said direct neutralization is carried out on said wet cellulose textile substrates without a prior rinsing after impregnation with said alkaline hydroxide.

22. A process according to claim 1 wherein said neutralizing fluid containing carbon dioxide comprises a solution of carbonic acid super saturated with gaseous carbon dioxide, thereby forming a gas-water-carbonic acid emulsion.

23. A process according to claim 1 wherein said neutralization is effected over a time period on the order of 15–20 seconds.

24. A process according to claim 1 wherein said neutralization is effected in two stages consisting of a first gaseous phase treatment wherein said wet cellulose textile substrate are contacted at least in part with gaseous carbon dioxide, and a second stage following said first stage in which said wet cellulose textile substrates are impregnated with water saturated with carbon dioxide.

25. A process for neutralizing a cellulose textile substrate, impregnated with alkaline hydroxide which is at least in part fixed on the cellulose in the form of alkalicellulose, comprising squeezing the wet cellulose textile to remove aqueous alkaline hydroxide liquid therefrom, thereby leaving a wet cellulose textile;

rapidly neutralizing said wet cellulose textile to a pH of at most 8.3 by contacting said wet cellulose textile with a neutralizing fluid containing carbon dioxide; and rinsing said neutralized cellulose textile with water.

* * * * *